US010439315B2

(12) United States Patent
Dai et al.

(10) Patent No.: US 10,439,315 B2
(45) Date of Patent: Oct. 8, 2019

(54) CONNECTOR ASSEMBLY

(71) Applicant: LOTES CO., LTD, Keelung (TW)

(72) Inventors: Yong Jun Dai, Keelung (TW); Jun Liu, Keelung (TW); Jian Cheng Qian, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/039,478

(22) Filed: Jul. 19, 2018

(65) Prior Publication Data

US 2019/0027855 A1 Jan. 24, 2019

(30) Foreign Application Priority Data

Jul. 21, 2017 (CN) ..... 2017 2 0889697 U

(51) Int. Cl.

| | |
|---|---|
| ***H01R 13/424*** | (2006.01) |
| ***H01R 12/57*** | (2011.01) |
| ***H01R 13/24*** | (2006.01) |
| ***H01R 13/66*** | (2006.01) |
| ***H01R 12/70*** | (2011.01) |

(Continued)

(52) U.S. Cl.

CPC ..... *H01R 13/424* (2013.01); *H01R 12/57* (2013.01); *H01R 12/7088* (2013.01); *H01R 13/24* (2013.01); *H01R 13/665* (2013.01); *H01R 13/6658* (2013.01); *H01R 12/53* (2013.01); *H01R 24/60* (2013.01); *H01R 2107/00* (2013.01)

(58) Field of Classification Search

CPC .... H01R 12/53; H01R 12/57; H01R 12/7088; H01R 13/24; H01R 13/424; H01R 13/665; H01R 13/6658; H01R 24/60; H01R 2107/00

See application file for complete search history.

(56) References Cited

U.S. PATENT DOCUMENTS 9,768,568 B1 * 9/2017 Jin ..... H01R 24/60
2009/0291596 A1 * 11/2009 Miyazoe ..... H01R 12/721 439/636

(Continued)

FOREIGN PATENT DOCUMENTS

| | | |
|---|---|---|
| CN | 104733956 A | 6/2015 |
| CN | 206195803 U | 5/2017 |
| TW | M397639 U | 2/2011 |

*Primary Examiner* — Oscar C Jimenez

(74) *Attorney, Agent, or Firm* — Locke Lord LLP; Tim Tingkang Xia, Esq.

(57) ABSTRACT

A plug connector includes: a circuit board; a mating joint having an insulating body and multiple conductive terminals provided on the insulating body; at least two outer power terminals; and a cable having at least two outer power lines, multiple inner power lines and multiple signal lines. The conductive terminals are electrically connected to the circuit board, and include multiple inner power terminals and multiple signal terminals. Each outer power terminal has a conducting portion and a tail portion. The tail portion is fixedly provided on the circuit board, and the conducting portion is located on a lateral side of the mating joint. Each outer power line is electrically connected to the tail portion of a corresponding outer power terminal. The inner power lines are electrically connected with the inner power terminals respectively. The signal lines are electrically connected with the signal terminals respectively.

16 Claims, 13 Drawing Sheets

(51) Int. Cl.

| | |
|---|---|
| ***H01R 12/53*** | (2011.01) |
| ***H01R 24/60*** | (2011.01) |
| ***H01R 107/00*** | (2006.01) |

(56) References Cited

U.S. PATENT DOCUMENTS

| | | | | |
|---|---|---|---|---|
| 2010/0151732 | A1* | 6/2010 | Xu | H01R 13/506<br>439/607.45 |
| 2013/0273773 | A1* | 10/2013 | Lan | H01R 12/57<br>439/566 |
| 2013/0344709 | A1* | 12/2013 | Kuo | H01R 12/724<br>439/55 |
| 2015/0207279 | A1* | 7/2015 | Little | H01R 24/60<br>439/607.01 |
| 2015/0364871 | A1* | 12/2015 | Lin | H01R 13/6581<br>439/607.58 |
| 2016/0204562 | A1* | 7/2016 | Chen | H01R 43/16<br>29/428 |
| 2017/0047691 | A1* | 2/2017 | Lin | H01R 13/6585 |
| 2018/0166825 | A1* | 6/2018 | Ju | H01R 13/6275 |

* cited by examiner

A-A

CONNECTOR ASSEMBLY

CROSS-REFERENCE TO RELATED PATENT APPLICATION

This non-provisional application claims priority to and the benefit of, pursuant to 35 U.S.C. § 119(a), patent application Serial No. CN201720889697.1, filed in China on Jul. 21, 2017. The disclosures of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to a connector assembly, and more particularly to a plug connector capable of transmitting a heavy current and a socket connector mated therewith.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Currently, an existing connector assembly includes a plug connector and a socket connector. Each of the conductive terminals of the plug connector and the socket connector is provided with an elastic sheet type terminal structure, which is configured to transmit signals and currents. With the development of miniaturization of the plug connector and the socket connector, and an increase in auxiliary functions between the electronic devices, requirements for signal transmission and current transmission between the electronic devices have increased. For example, rapid charging of mobile devices and the like are increasingly required. However, due to the structural limitations of the terminals in the plug connector and the socket connector, a heavy current cannot be transmitted, resulting in a limited application of the connector assembly.

Therefore, a heretofore unaddressed need to design a novel plug connector and a socket connector mated therewith exists in the art to address the aforementioned deficiencies and inadequacies.

SUMMARY

The invention is directed to a plug connector and a socket connector mated therewith, which are capable of transmitting a heavy current.

To achieve the foregoing objective, the present invention adopts the following technical solutions:

A plug connector includes: a circuit board; a mating joint, having an insulating body and a plurality of conductive terminals provided on the insulating body, wherein the conductive terminals are electrically connected to the circuit board, and the conductive terminals include a plurality of inner power terminals and a plurality of signal terminals; at least two outer power terminals, wherein each of the outer power terminals has a conducting portion and a tail portion, the tail portion is fixedly provided on the circuit board, and the conducting portion is located on a lateral side of the mating joint; and a cable, having at least two outer power lines, a plurality of inner power lines and a plurality of signal lines, wherein each of the at least two outer power lines is electrically connected to the tail portion of a corresponding one of the at least two outer power terminals, the inner power lines are electrically connected with the inner power terminals respectively, and the signal lines are electrically connected with the signal terminals respectively.

In certain embodiments, each of the at least two outer power lines is directly connected to the tail portion of the corresponding one of the at least two outer power terminals.

In certain embodiments, power transmitted by the at least two outer power terminals is greater than power transmitted by the inner power terminals.

In certain embodiments, the plug connector includes four outer power terminals, wherein each of two opposite sides of the mating joint are respectively provided with two of the four outer power terminals, and the conducting portions of the four outer power terminals on the two sides of the mating joint are symmetrically provided.

In certain embodiments, a front end of the insulating body is backward concavely provided with a mating slot, each of the conductive terminals has a first contact portion protruding into the mating slot, the first contact portions of the conductive terminals are provided in two rows on an upper side and a lower side of the mating slot, the two rows of the first contact portions are symmetrical about a center of the mating slot at 180 degrees, and the conducting portions of the four outer power terminals distributed on a left side and a right side of the mating joint are symmetrical about the center of the mating slot at 180 degrees.

In certain embodiments, the two outer power terminals located at each side of the mating joint comprises a positive pole and a negative pole, and the polarities of the outer power terminals located at the opposite sides of the mating joint are symmetrical about the center of the mating slot at 180 degrees.

In certain embodiments, each of the outer power terminals is fixed to the circuit board by soldering at the tail portion thereof.

In certain embodiments, a front end of the circuit board is provided with a plurality of first solder pads and at least two second solder pads, the conductive terminals are soldered to the first solder pads, and the tail portions of the at least two outer power terminals are soldered to the at least two second solder pads; and the circuit board further has a plurality of third solder pads electrically connected with the first solder pads, and the inner power lines and the signal lines are correspondingly soldered with the third solder pads.

In certain embodiments, one side of the tail portion of each of the at least two outer power terminals adjacent to the circuit board has a soldering plane, and the soldering plane is soldered to a corresponding one of the at least two second solder pads.

In certain embodiments, the at least two second solder pads are located in front of the first solder pads in a front-rear direction.

In certain embodiments, the circuit board is provided with a notch between the first solder pads and the second solder pads, and the notch reserves a space for the insulating body.

In certain embodiments, the plug connector further includes an insulating fixing member, wherein the insulating fixing member is provided at a rear end of the mating joint and at the tail portions of the at least two outer power terminals, the insulating fixing member has a front end surface, and a front end of the mating joint and the conducting portions of the at least two outer power terminals respectively protrude out of the front end surface.

In certain embodiments, the conducting portions of the at least two outer power terminals are movable relative to the front end surface along a front-rear direction.

In certain embodiments, the insulating fixing member has a projecting portion formed by protruding forward from the front end surface, the projecting portion is formed around the conducting portions of the at least two outer power terminals, and a front end of each of the conducting portions of the at least two outer power terminals protrudes forward out of the projecting portion.

In certain embodiments, an engaging slot is concavely formed forward from a rear end of the insulating fixing member and is configured to clamp the circuit board, and each of the tail portions of the at least two outer power terminals has a solder plane which is exposed from the engaging slot and configured to be attached and soldered to the circuit board.

In certain embodiments, a front end of the insulating body is backward concavely provided with a mating slot, each of the conductive terminals has a first contact portion protruding into the mating slot, the first contact portions of the conductive terminals are provided in two rows on an upper side and a lower side of the mating slot, and the conducting portions of the at least two outer power terminals are located behind the first contact portions of the conductive terminals in a front-rear direction.

A connector assembly includes: a plug connector, including: a circuit board; a mating joint, having an insulating body and a plurality of conductive terminals provided on the insulating body, wherein the conductive terminals are electrically connected to the circuit board, and the conductive terminals include a plurality of inner power terminals and a plurality of signal terminals; at least two outer power terminals, wherein each of the outer power terminals has a conducting portion and a tail portion, the tail portion is fixedly provided on the circuit board, and the conducting portion is located on a lateral side of the mating joint; and a cable, having at least two outer power lines, a plurality of inner power lines and a plurality of signal lines, wherein each of the at least two outer power lines is electrically connected to the tail portion of a corresponding one of the at least two outer power terminals, the inner power lines are electrically connected with the inner power terminals respectively, and the signal lines are electrically connected with the signal terminals respectively; and a socket connector, mated with the plug connector, including: a plastic body; a plurality of mating terminals, provided on the plastic body; a metal shell, provided outside the plastic body and forming a mating frame port for the mating joint to be inserted therein, wherein each of the mating terminals has a second contact portion provided in the mating frame port, and the second contact portion is in contact with one of the conductive terminals to form an electrical connection; an insulating seat, provided outside the metal shell, wherein the insulating seat has a mating surface, and the mating frame port is exposed from the mating surface; and at least two mating power terminals, provided on the insulating seat, wherein the mating power terminals are located outside the mating frame port and are in contact with the corresponding conducting portions to form another electrical connection.

In certain embodiments, the at least two outer power lines are soldered correspondingly to the tail portions of the at least two outer power terminals.

In certain embodiments, power transmitted by the at least two outer power terminals is greater than power transmitted by the inner power terminals.

In certain embodiments, the socket connector further includes a metal fixing member provided outside the insulating seat, wherein the metal fixing member has a top plate and two side plates respectively extending downward from two sides of the top plate, the top plate and the metal shell are provided to be vertically separated, the metal fixing member has at least one connecting sheet formed by bending downward from the top plate, the connecting sheet and the metal shell are fixed to each other by spot welding or laser, and each of the side plates has at least one fixing leg configured to be connected with a main board.

Compared with the related art, in certain embodiments of the present invention, by additionally providing the outer power terminals in the plug connector and additionally providing the mating power terminals in the socket connector, when the plug connector is mated with the socket connector, the outer power terminals are in contact with the mating power terminals, and the conductive terminals, which includes the inner power terminals and the signal terminals, are simultaneously in contact with the mating terminals to form an electrical connection. Thus, the plug connector and the socket connector simultaneously transmit currents through the inside and outside to implement additional current transmission. In addition, the outer power terminals are fixedly provided on the circuit board inside the plug connector, and the outer power lines in the cable are electrically connected to the tail portions of the outer power terminals. Thus, the outer power terminals can be stably fixed relative to the circuit board.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
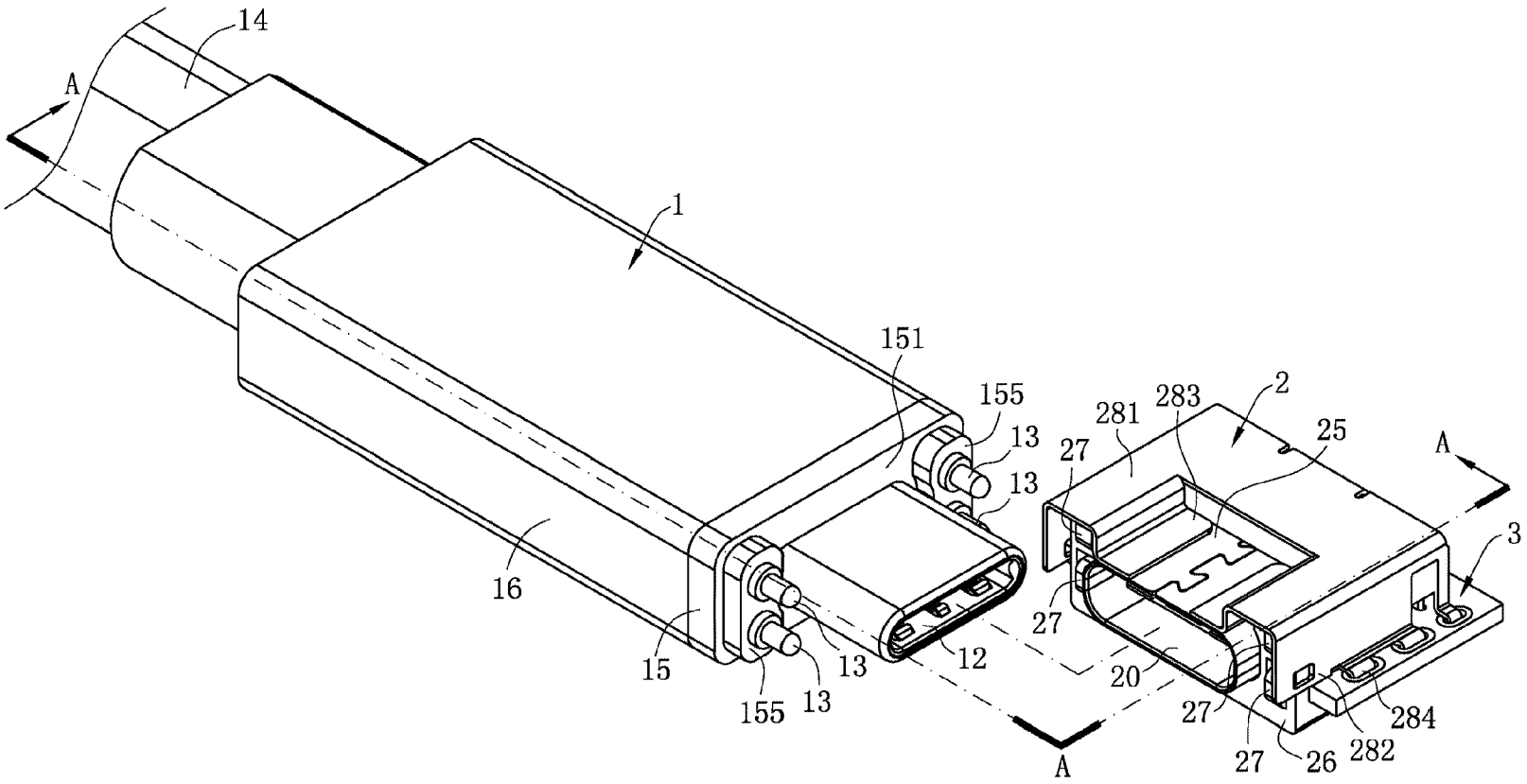
FIG. 1 is a perspective view of a plug connector and a socket connector mounted on a main board according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-13. In accordance with the purposes of this invention, as embodied and broadly described herein, this invention, in one aspect, relates to a connector assembly.

Figure 10:
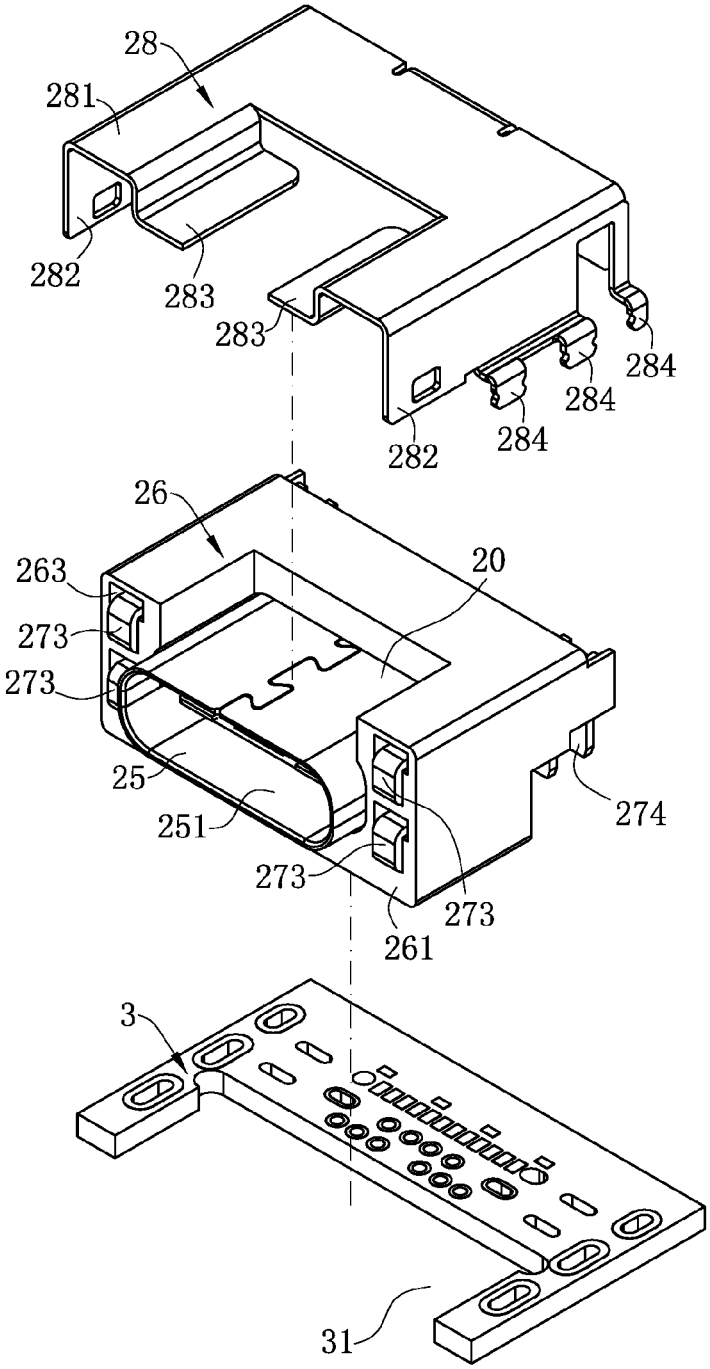
FIG. 10 is a perspective view of a terminal module being mounted on an insulating seat in FIG. 9.

Referring to FIG. 1 and FIG. 10, a connector assembly according to certain embodiments of the present invention is provided, which includes a plug connector 1 and a socket connector 2 mated therewith. The plug connector 1 and the socket connector 2 can be mated with each other forwardly or reversely in a front-rear direction. The socket connector 2 is a sunken plate structure, and is mounted on a main board 3. One end of the main board 3 has a mounting notch 31, and the bottom of the socket connector 2 is accommodated in the mounting notch 31.

Figure 2:
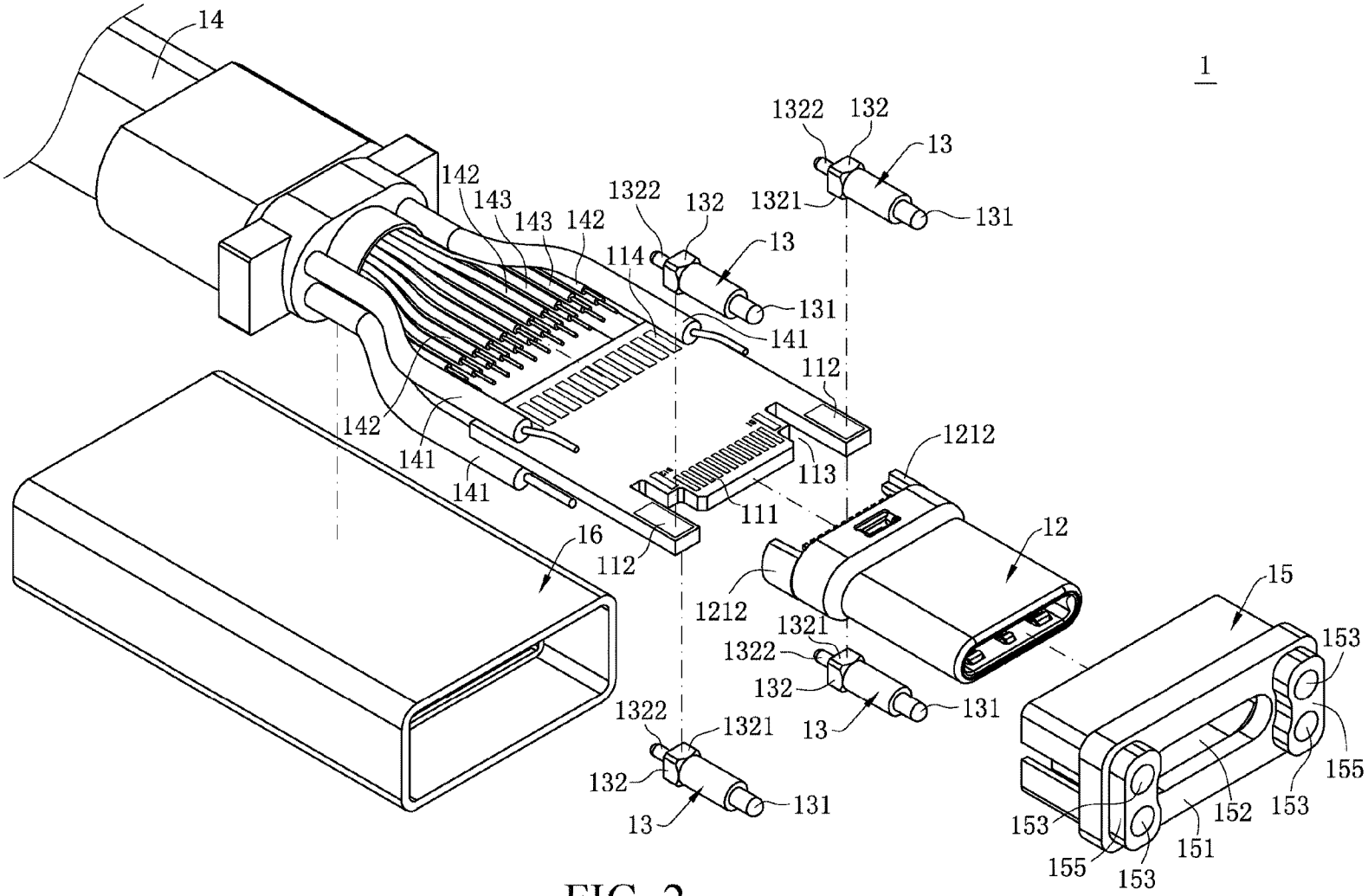
FIG. 2 is a perspective exploded view of the plug connector in FIG. 1.
Figure 5:
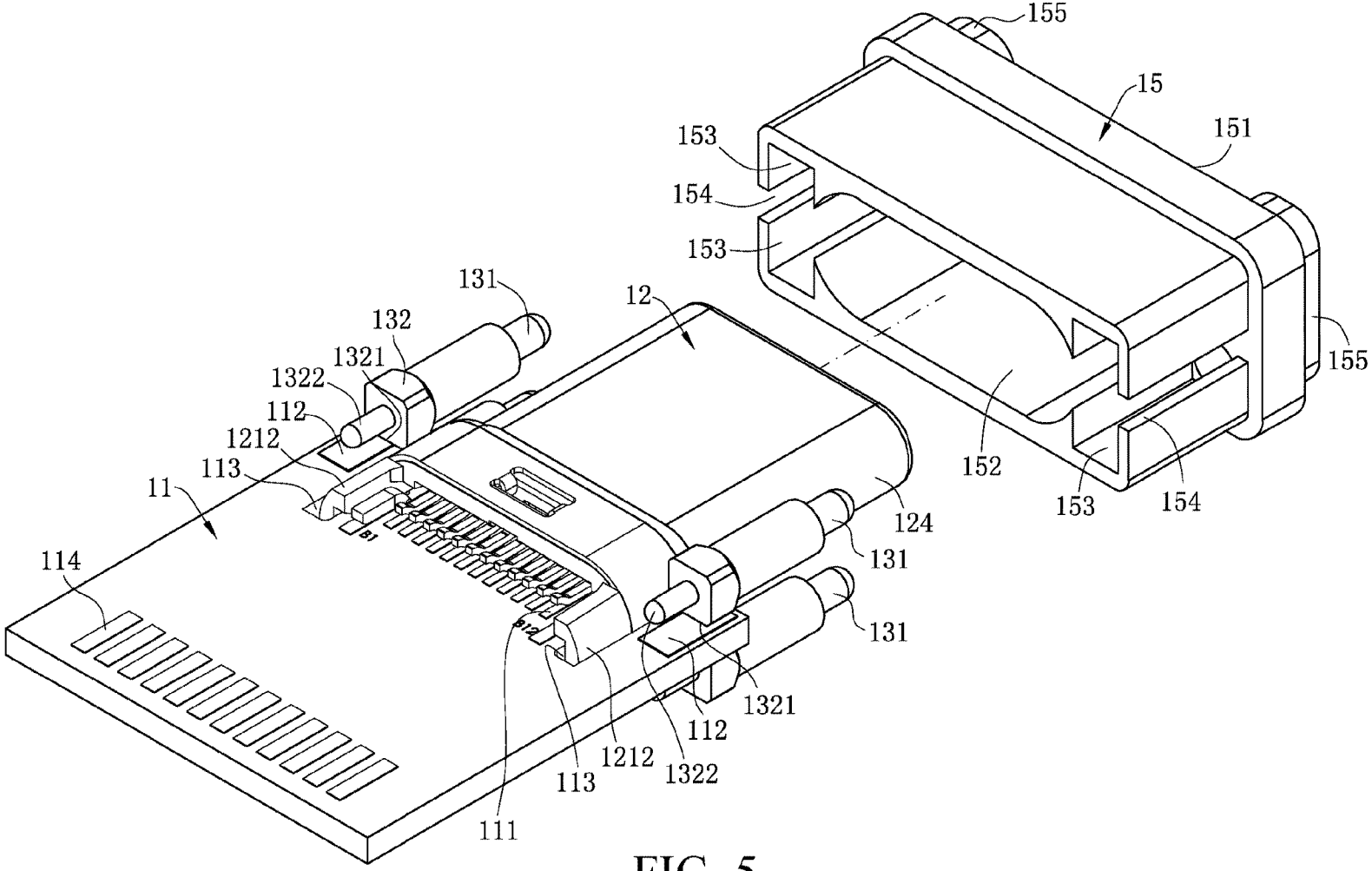
FIG. 5 is a perspective view of the outer power terminals and the mating joint being soldered with the circuit board in FIG. 2.

Referring to FIG. 2 and FIG. 5, the plug connector 1 includes a circuit board 11, a mating joint 12 electrically connected to one end of the circuit board 11, multiple outer power terminals 13 fixedly provided on the circuit board 11, an insulating fixing member 15 provided on a rear end of the mating joint 12 and rear ends of the outer power terminals 13, a cable 14 electrically connected to the other end of the circuit board 11, and an insulating shell 16 covering a front end of the cable 14 and the circuit board 11.

Referring to FIG. 2 and FIG. 5, the front end of the circuit board 11 is provided with multiple first solder pads 111 and multiple second solder pads 112. In this embodiment, the first solder pads 111 are distributed on an upper surface and a lower surface of the circuit board 11. The number of the first solder pads 111 on each surface of the circuit board 11 is twelve. The first solder pads 111 on the upper surface and the lower surface of the circuit board 11 are correspondingly provided vertically. The number of the second solder pads 112 is four. Each of the two sides of the front end of the circuit board 11 is provided with two of the four second solder pads 112. The two second solder pads 112 on each side of the circuit board 11 are correspondingly provided vertically and distributed on the upper surface and the lower surface of the circuit board 11. On each surface of the circuit board 11, the first solder pads 111 are located between the two second solder pads 112. The second solder pads 112 are located in front of the first solder pads 111 in a front-rear direction. Each side of the circuit board 11 is provided with a notch 113 between the first solder pads 111 and the second solder pads 112, and the notch 113 is concavely formed backward from a front end edge of the circuit board 11. The rear end of the circuit board 11 is provided with multiple third solder pads 114. The third solder pads 114 are also distributed on the upper surface and the lower surface of the circuit board 11. The number of the third solder pads 114 on each surface of the circuit board 11 is equal to the number of the first solder pads 111 on each surface of the circuit board 11, and the third solder pads 114 are correspondingly electrically connected with the first solder pads 111 on the same surface.

Figure 3:
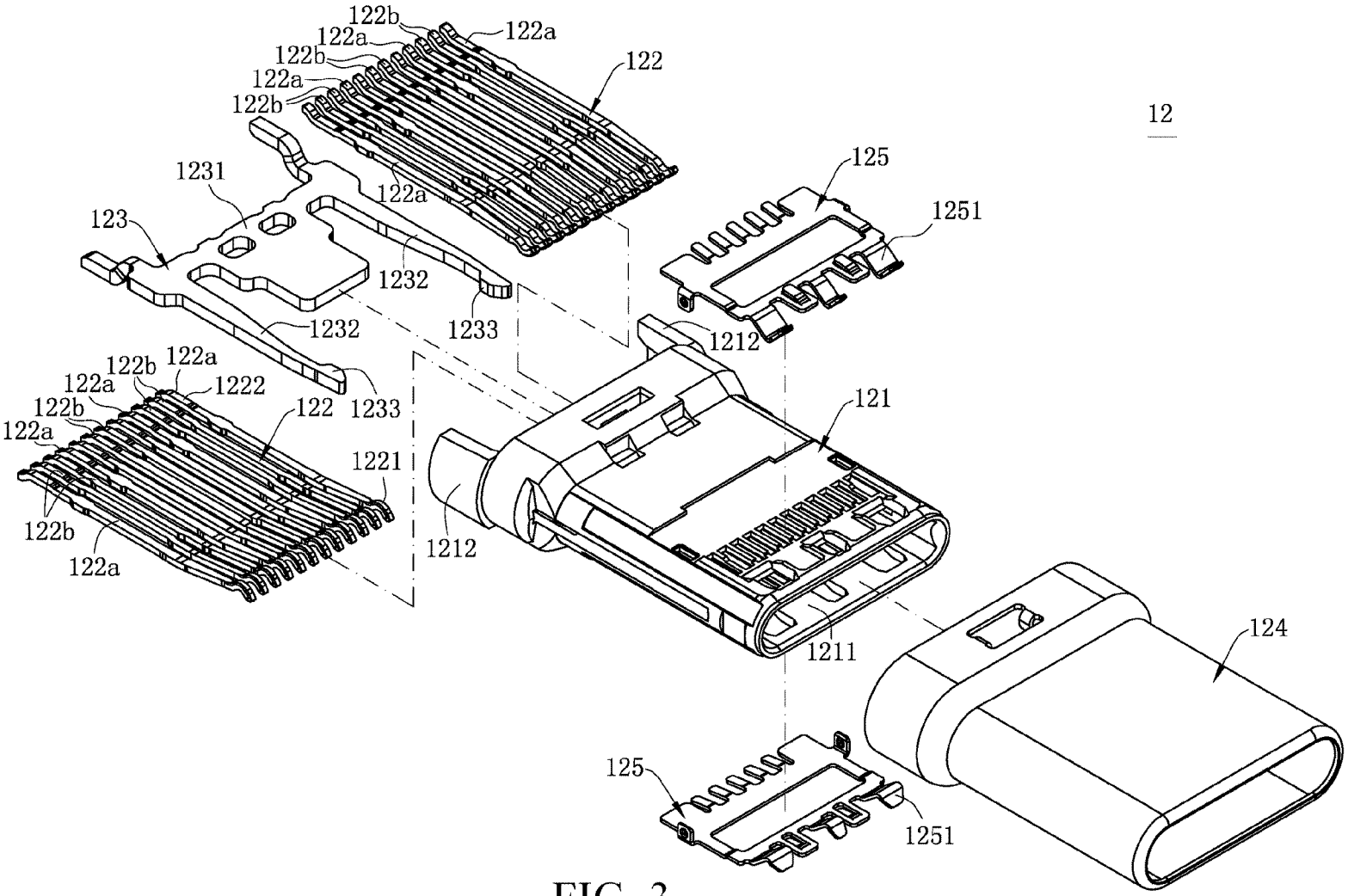
FIG. 3 is a perspective exploded view of a mating joint in FIG. 2.

Referring to FIG. 2 and FIG. 3, the mating joint 12 has an insulating body 121, multiple conductive terminals 122 provided on the insulating body 121, a latch member 123, a shielding shell 124 sleeved over the insulating body 121, and two grounding elastic sheets 125 respectively provided on an upper surface and a lower surface of the insulating body 121. A mating slot 1211 is concavely formed backward from the front end of the insulating body 121. The insulating body 121 further has two stopping blocks 1212 extending backward respectively from two sides of the rear end thereof, and each of the stopping blocks 1212 is clamped to a corresponding notch 113. The conductive terminals 122 are provided in two rows, and each row of the conductive terminals 122 includes multiple inner power terminals **122*a* and multiple signal terminals 122*b*. Each of the conductive terminals 122 has a first contact portion 1221 protruding forward into the mating slot 1211 and a first soldering portion 1222 extending backward out of the insulating body 121. The first contact portion 1221 is an elastic contact arm structure. The first contact portions 1221 of the conductive terminals 122 are also provided in two rows on an upper side and a lower side of the mating slot 1211. The two rows of first contact portions 1221 are symmetrical about a center of the mating slot 1211 at 180 degrees. The first soldering portions 1222 are also correspondingly provided in an upper row and a lower row. The front end of the circuit board 11 is located between the two rows of first soldering portions 1222, and the first soldering portions 1222 are correspondingly soldered to the first solder pads 111. In this embodiment, the number of the conductive terminals 122 in each row is twelve. The conductive terminals 122 in each row includes, sequentially from left to right, a grounding terminal, a pair of differential signal terminals (high-speed terminals) for transmitting universal serial bus (USB) 3.0 signals, a power terminal, a reserved terminal, a pair of USB 2.0 terminals, a reserved terminal, a power terminal, a pair of differential signal terminals (high-speed terminals) for transmitting USB 3.0 signals and a grounding terminal. Each of the reserved terminals may be used for detection or used for providing signals or power supply. Therefore, the inner power terminals 122***a* include the power terminal and the grounding terminal, and certainly may further include any reserved terminal used as the power supply. The power terminal refers to a positive pole power terminal, and the grounding terminal refers to a negative pole power terminal. The signal terminals 122*b* include the USB 2.0 terminal and the differential signal terminal 122*b* for transmitting USB 3.0 signals, and certainly may further include any reserved terminal used for detection and for signals. The latch member 123 is formed by blanking a metal sheet material. The latch member 123 has a shielding body 1231 located between the two rows of the conductive terminals 122 and two latch arms 1232 formed by extending forward respectively from both sides of the shielding body 1231. The shielding body 1231 is used for shielding signal interference between the two rows of the conductive terminals 122. The two latch arms 1232 are located on the left and right sides of the insulating body 121, and each of the latch arms 1232 has a latch portion 1233 protruding into the mating slot 1211. The shielding shell 124 is a seamlessly connected tubular structure formed by an drawing process. Each of the grounding elastic sheets 125 is sandwiched between the insulating body 121 and the shielding shell 124, and each of the grounding elastic sheets 125 has multiple grounding contacts 1251 protruding into the mating slot 1211. The grounding contacts 1251 are located in front of the second contact portion 221, and the grounding elastic sheets 125 are in contact with the shielding shell 124 to form grounding.

Referring to FIG. 1, FIG. 2 and FIG. 3, two sides of the mating joint 12 are respectively provided with two of the outer power terminals 13 vertically provided correspondingly, and the four outer power terminals 13 are provided in two rows in the vertical direction. Of the two outer power terminals 13 vertically provided correspondingly, one is a positive pole power terminal, and the other is a negative pole power terminal. Similarly, of the two outer power terminals 13 in the same row, one is a positive pole power terminal, and the other is a negative pole power terminal. Each of the outer power terminals 13 has a conducting portion 131 located at a front end thereof and a tail portion 132 located at a rear end thereof. The conducting portion 131 is located at a lateral side of the mating joint 12. In other words, the conducting portion 131 is located outside the mating joint 12 instead of on the mating joint 12. Further, the conducting portions 131 of the outer power terminals 13 are located behind the first contact portion 1221 of the conductive terminals 122 in the front-rear direction, and the conducting portions 131 of the outer power terminals 13 distributed on both sides of the mating joint 12 are provided symmetrically. In this embodiment, each of the outer power terminals 13 is a spring type probe structure, and thus can transmit a heavy current. The conducting portion 131 is movable in the front-rear direction relative to the tail portion 132. The conducting portions 131 of the outer power terminals 13 distributed on the left and right sides of the mating joint 12 are symmetrical about the center of the mating slot 1211 at 180 degrees, and the polarities of the outer power terminals 13 located on the opposite sides of the mating joint 12 are symmetrical about the center of the mating slot 1211 at 180 degrees. The tail portion 132 of each of the outer power terminals 13 is located on the upper side or the lower side of the circuit board 11. One side of the tail portion 132 adjacent to the circuit board 11 has a soldering plane 1321. The soldering plane 1321 is attached and soldered to the second solder pad 112. Therefore, the outer power terminals 13 are fixedly provided on the circuit board 11 (also referring to FIG. 7 and FIG. 8). The tail portion 132 of each of the outer power terminals 13 further has a soldering leg 1322 extending backward, and the soldering leg 1322 is isolated from the circuit board 11. Power transmitted by the outer power terminals 13 provided outside the mating joint 12 is greater than power transmitted by the inner power terminals 122*a* in the mating joint 12. Thus, it is possible to additionally transmit a heavy current.

Figure 4:
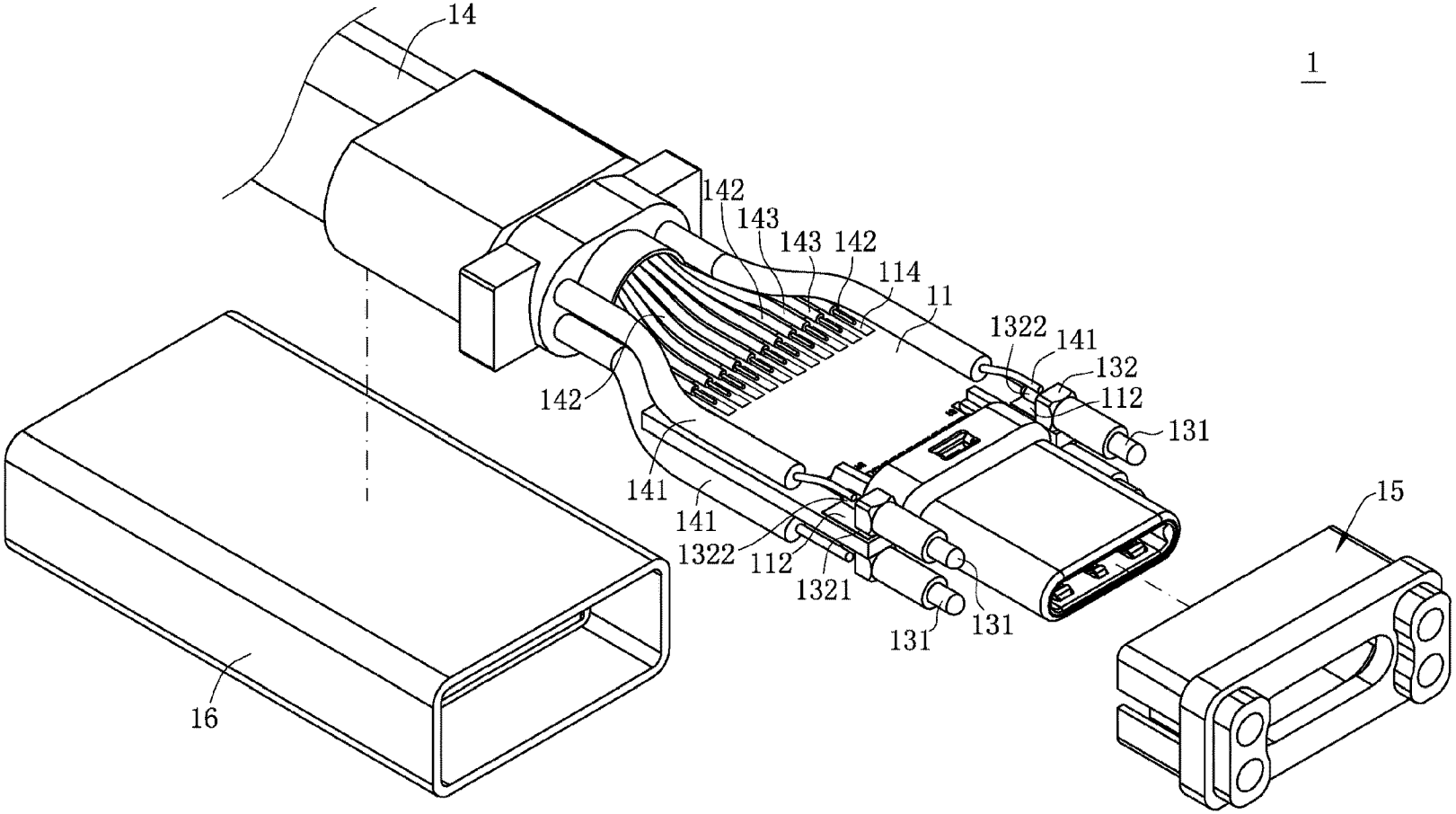
FIG. 4 is a perspective view of outer power terminals, the mating joint and a cable being soldered with a circuit board in FIG. 2.

Referring to FIG. 2, FIG. 4 and FIG. 5, the cable 14 includes multiple outer power lines 141, multiple inner power lines 142 and multiple signal lines 143. The number of the outer power lines 141 is identical to the number of the outer power terminals 13, the number of the inner power lines 142 is identical to the number of the inner power terminals 122*a*, and the number of the signal lines 143 is identical to the number of the signal terminals 122*b*. Therefore, the number of the outer power lines 141 is four. Each of the outer power lines 141 corresponds to one of the outer power terminals 13, and the outer power line 141 is directly soldered to the soldering leg 1322. Since the soldering leg 1322 is located at the front end of the circuit board 11, the soldering point of the outer power line 141 and the soldering leg 1322 is adjacent to the front end of the circuit board 11. In this embodiment, the signal lines 143 are coaxial lines, and the inner power line 142 and the signal line 143 are soldered to the corresponding third solder pad 114.

Referring to FIG. 2 and FIG. 5, the insulating fixing member 15 has a front end surface 151, a through hole 152 and multiple accommodating holes 153. In this embodiment, the number of the accommodating holes 153 is four. Each of both sides of the through hole 152 is respectively provided with two of the accommodating holes 153 which are vertically provided correspondingly. The through hole 152 and the accommodating holes 153 respectively penetrate through the insulating fixing member 15 in a front-rear direction. The insulating fixing member 15 is assembled to the mating joint 12 backward from the front thereof, such that the mating joint 12 is accommodated in the through hole 152, and the front end of the mating joint 12 protrudes forward out of the front end surface 151. Meanwhile, the outer power terminals 13 are fixedly provided in the accommodating holes 153, the conducting portions 131 protrude out of the front end surface 151, and the tail portions 132 are completely accommodated in the accommodating holes 153. The insulating fixing member 15 further has two engaging slots 154. The engaging slots 154 are concavely formed forward from the rear end of the insulating fixing member 15, and do not penetrate through the front end surface 151. The two engaging slots 154 are distributed on the left and right sides of the accommodating hole 153, and the two engaging slots 154 are used for clamping both sides of the front end of the circuit board 11. Each of the accommodating holes 153 is located on the upper side or the lower side of the engaging slots 154, and is communicated vertically with the engaging slot 154 on the same side of the through hole 152. The soldering planes 1321 are exposed from the engaging slots 154. The insulating fixing member 15 has two projecting portions 155 protruding forward from the front end surface 151. The two projecting portions 155 are located at the left side and the right side of the insulating fixing member 15. Each of the projecting portions 155 is formed around the two conducting portions 131 vertically provided correspondingly on the same side of the through hole 152, and the front end of each conducting portions 131 protrudes forward out of the corresponding projecting portion 155. The arrangement of the projecting portions 155 can enhance the retention to the corresponding outer power terminals 13, thereby avoiding the phenomenon that the outer power terminals 13 protrude out of the front end surface for too long and are susceptible to force deflection.

Referring to FIG. 1 and FIG. 2, the insulating shell 16 covers the rear end of the insulating fixing member 15, the circuit board 11 and the front end of the cable 14. The insulating shell 16 can be formed by one injection molding or multiple injection molding.

Figure 6:
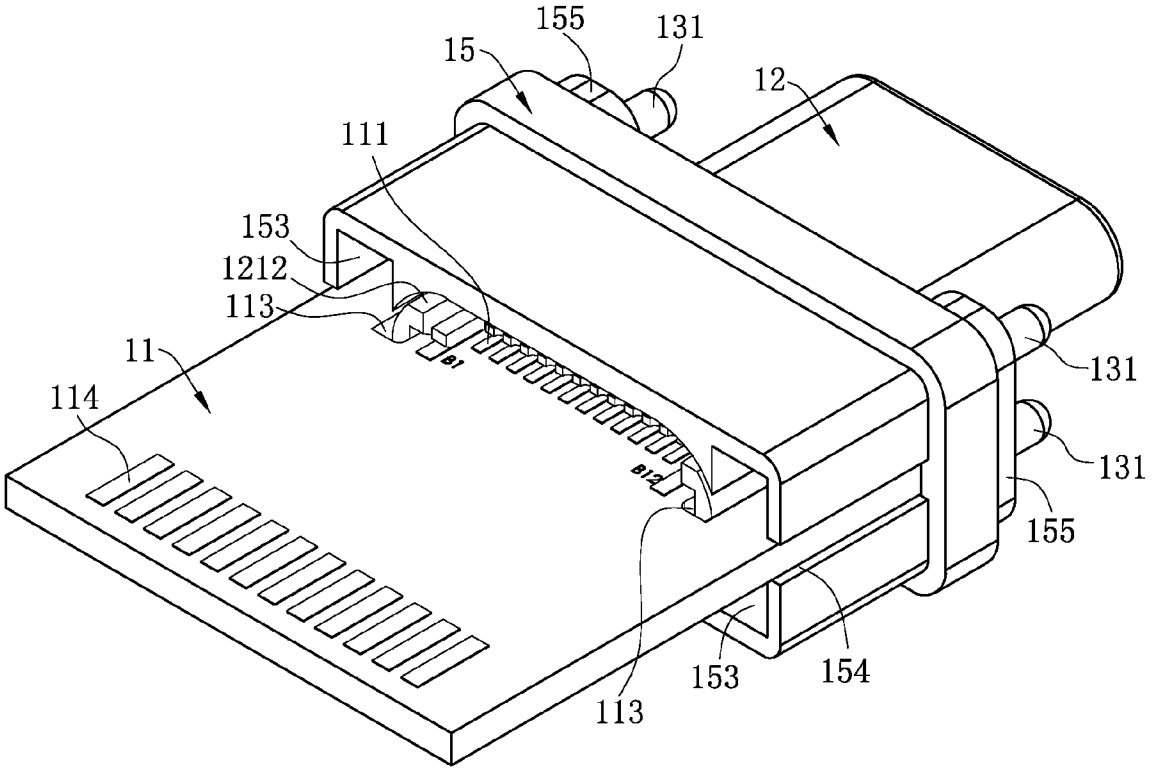
FIG. 6 is an assembled view of FIG. 5.
Figure 7:
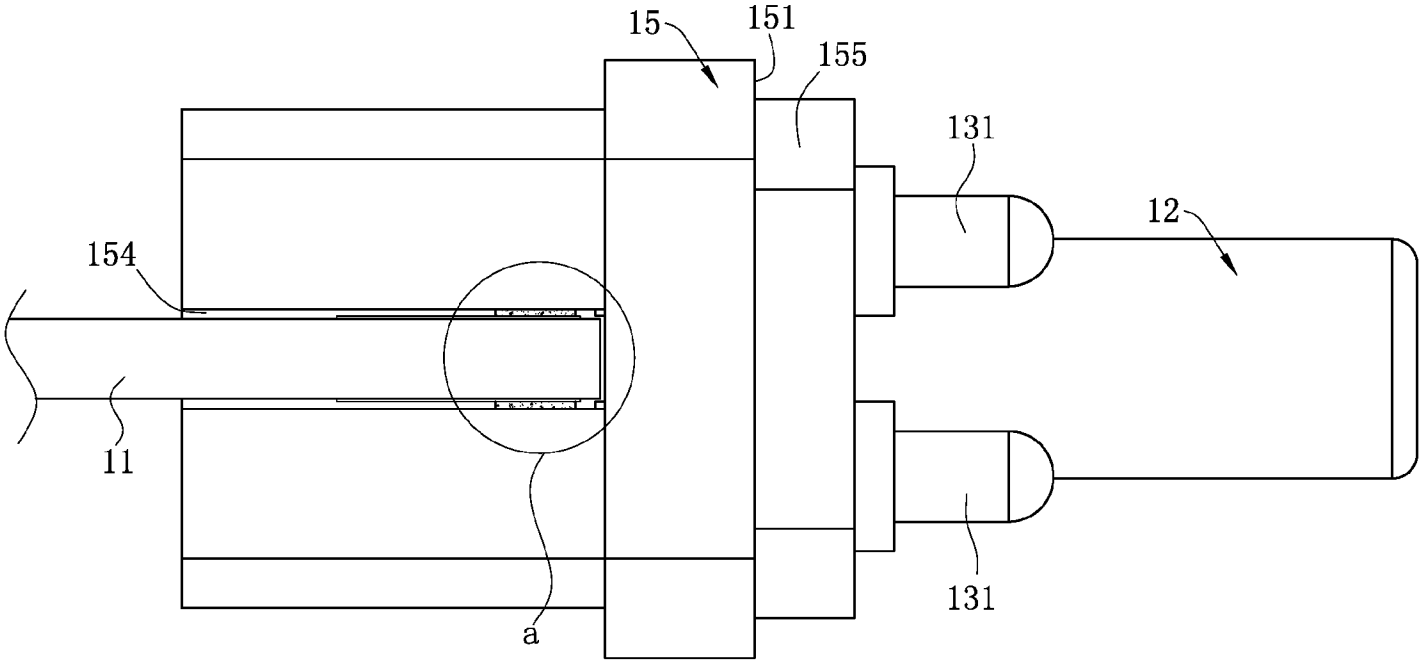
FIG. 7 is a side view of FIG. 6.
Figure 8:
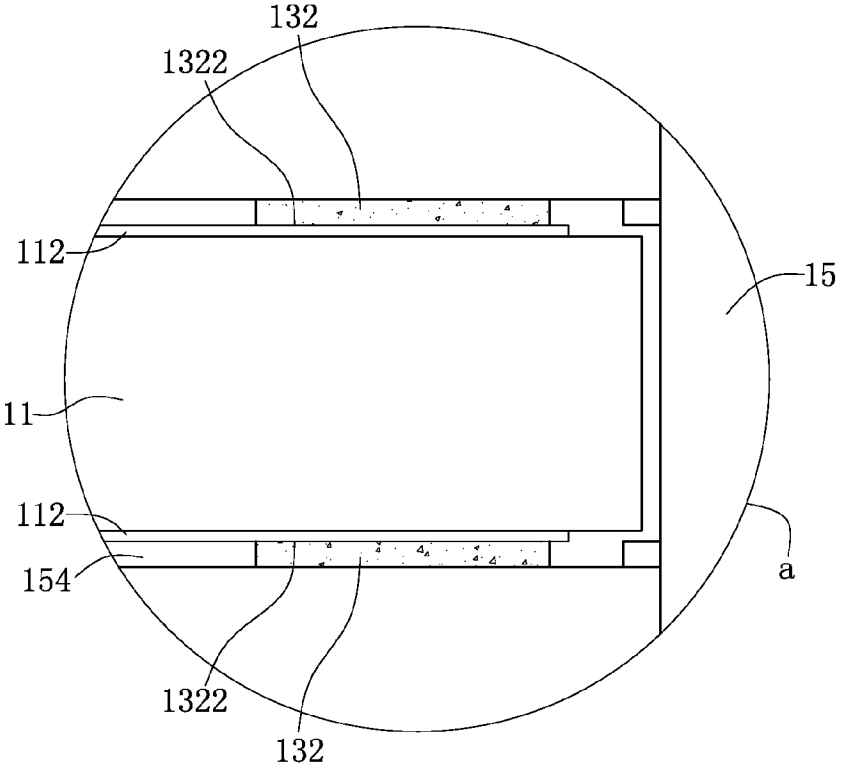
FIG. 8 is an enlarged view of a part a in FIG. 7.

Referring to FIG. 2, FIG. 5 and FIG. 6, in this embodiment, the mating joint 12 is firstly soldered to the circuit board 11. Next, the outer power terminals 13 are retained in the insulating fixing member 15. Then, the insulating fixing member 15 retained with the outer power terminals 13 is assembled to the mating joint 12 and the circuit board 11 backward from the front thereof. The outer power lines 141 of the cable 14 are then inserted into the accommodating holes 153 and soldered with the tail portions 132 of the outer power terminals 13 through solders. The inner power lines 142 and the signal lines 143 are soldered with the third solder pads 114. Finally, the insulating shell 16 is formed by injection-molding outside the circuit board 11, outside the rear end of the mating joint 12, outside the rear end of the insulating fixing member 15 and outside the front end of the cable 14.

Figure 9:
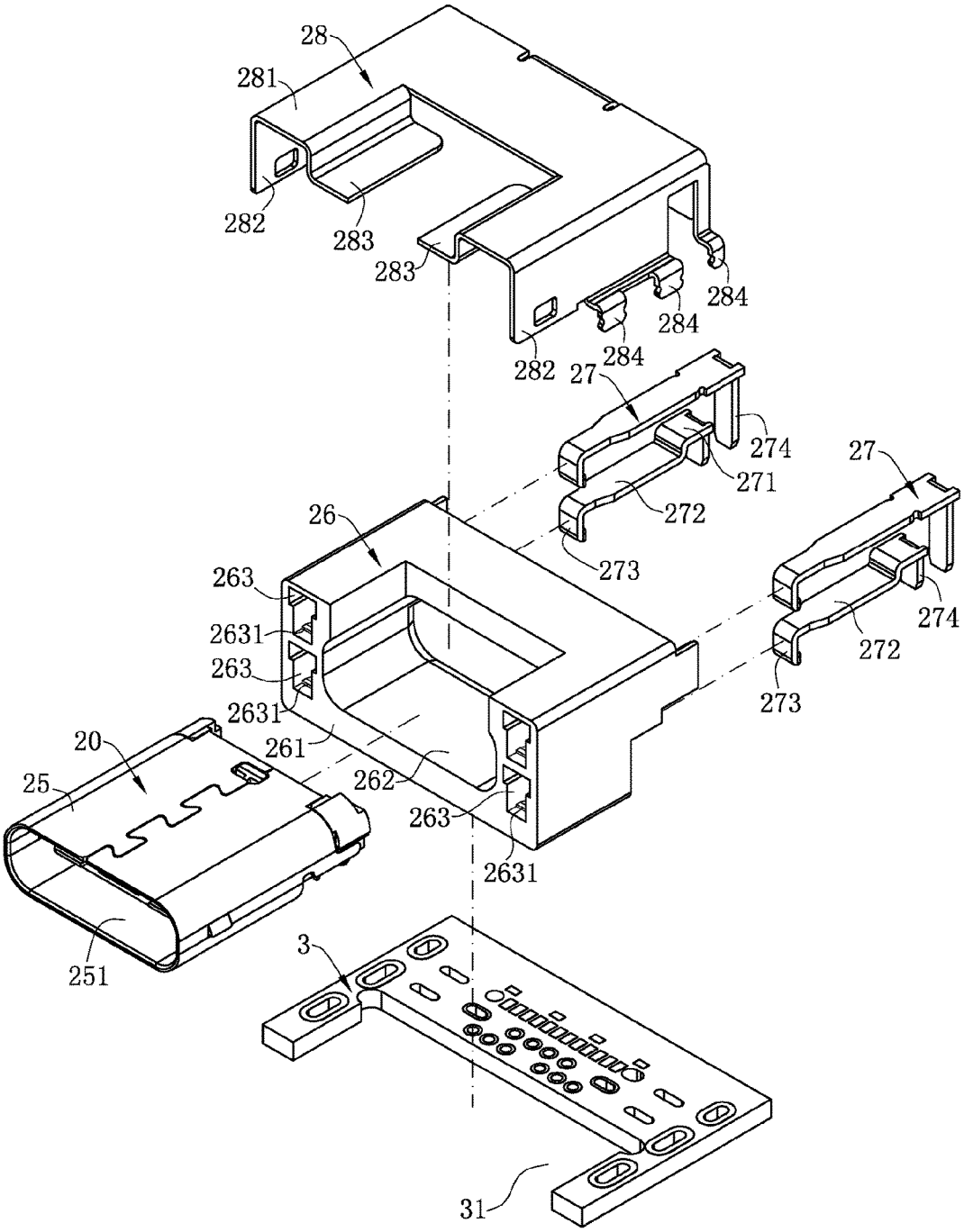
FIG. 9 is a perspective exploded view of the socket connector and the main board in FIG. 1.
Figure 11:
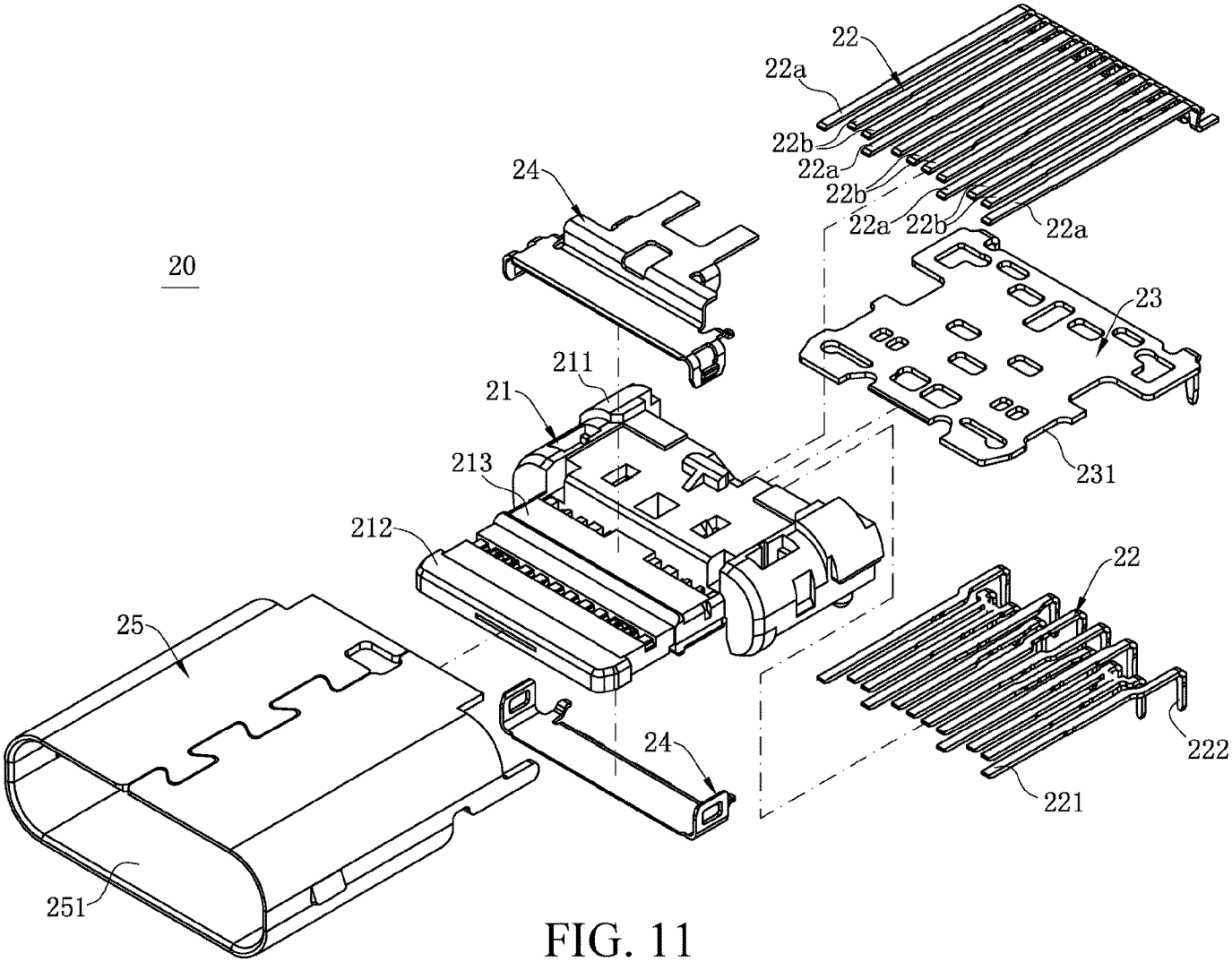
FIG. 11 is a perspective exploded view of the terminal module in FIG. 9.

Referring to FIG. 3, FIG. 9 and FIG. 11, the socket connector 2 includes a terminal module 20, an insulating seat 26 provided outside the terminal module 20, multiple mating power terminals 27 provided on the insulating seat 26 and a metal fixing member 28 provided outside the insulating seat 26. The terminal module 20 includes a plastic body 21, multiple mating terminals 22 and a middle shielding plate 23 provided on the plastic body 21, two grounding members 24, and a metal shell 25 sleeved over the plastic body 21. The number of the mating power terminals 27 is correspondingly equal to the number of the outer power terminals 13.

Referring to FIG. 9 and FIG. 11, the terminal module 20 is a common USB type-C structure. The plastic body 21 has a base 211, a tongue 212 located at one end of the base 211, and a step portion 213 provided between the base 211 and the tongue 212. The base 211, the step portion 213 and the tongue 212 are sequentially provided in the front-rear direction. The mating terminals 22 are provided in two rows vertically on the plastic body 21. Each row of the mating terminals 22 includes multiple internal power terminals **22*a* and multiple signal terminals 22*b*. The number of the mating terminals 22 in each row is twelve. The mating terminals 22 in each row include, sequentially from left to right, a grounding terminal, a pair of differential signal terminals (high-speed terminals) for transmitting USB 3.0 signals, a power terminal, a reserved terminal, a pair of USB 2.0 terminals, a reserved terminal, a power terminal, a pair of differential signal terminals (high-speed terminals) for transmitting USB 3.0 signals and a grounding terminal. The reserved terminals may be used for detection, and may also be used for signal or a power supply. Therefore, the internal power terminals 22*a* include the power terminal and the grounding terminal, and certainly may further include any reserved terminal as the power supply. The power terminal refers to the positive pole power terminal, and the grounding terminal refers to the negative pole power terminal. Each of the mating terminals 22 has a contact portion 221 and a second soldering portion 222. The second contact portion 221 is in a flat plate shape. The second contact portions 221 of the mating terminals 22 are correspondingly provided in two rows, and the two rows of the second contact portions 221 are correspondingly exposed from an upper surface and a lower surface of the tongue 212. The second contact portions 221 on each surface of the tongue 212 are provided side by side in the left-right direction, and the second soldering portions 222 are exposed from the plastic body 21 and connected to the main board 3. The middle shielding plate 23 is located between the two rows of the second contact portions 221. The left side and the right side of the middle shielding plate 23 correspondingly protrude out of the left side and the right side of the tongue 212. The middle shielding plate 23 also has two latch notches 231 correspondingly exposed from the left side and the right side of the tongue 212. The two grounding members 24 are provided on the upper surface and the lower surface of the step portion 213 opposite to each other. The two grounding members 24 are buckled to each other on the left side and the right side of the step portion 213, and the grounding members 24 are in contact with the metal shell 25. The metal shell 25 is sleeved over the plastic body 21. The metal shell 25 surrounds the tongue 212 to form a mating frame port 251, and the two rows of the second contact portions 221 are symmetrical about a center of the mating frame port 251** at 180 degrees.

Figure 12:
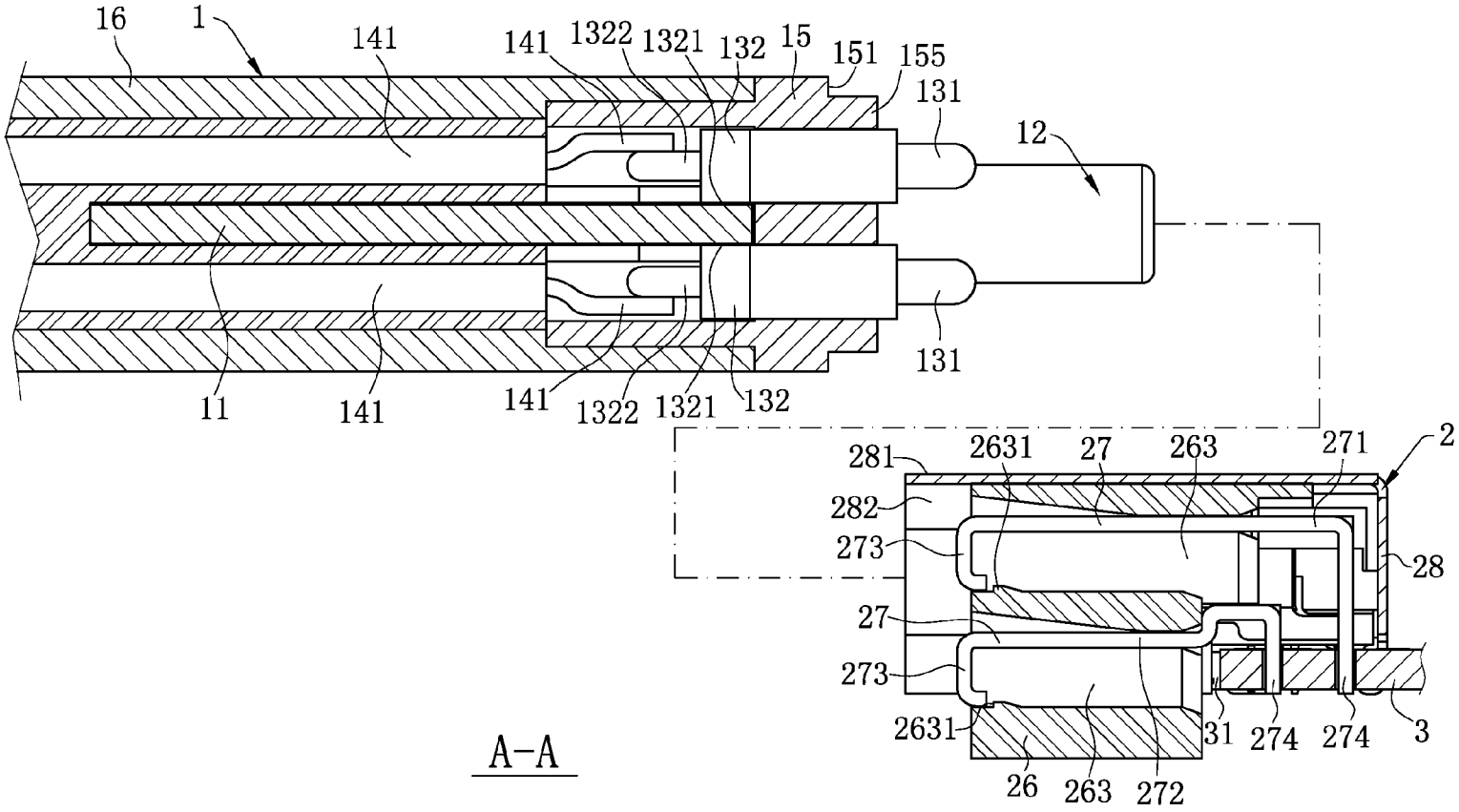
FIG. 12 is a sectional view along the A-A line in FIG. 1.
Figure 13:
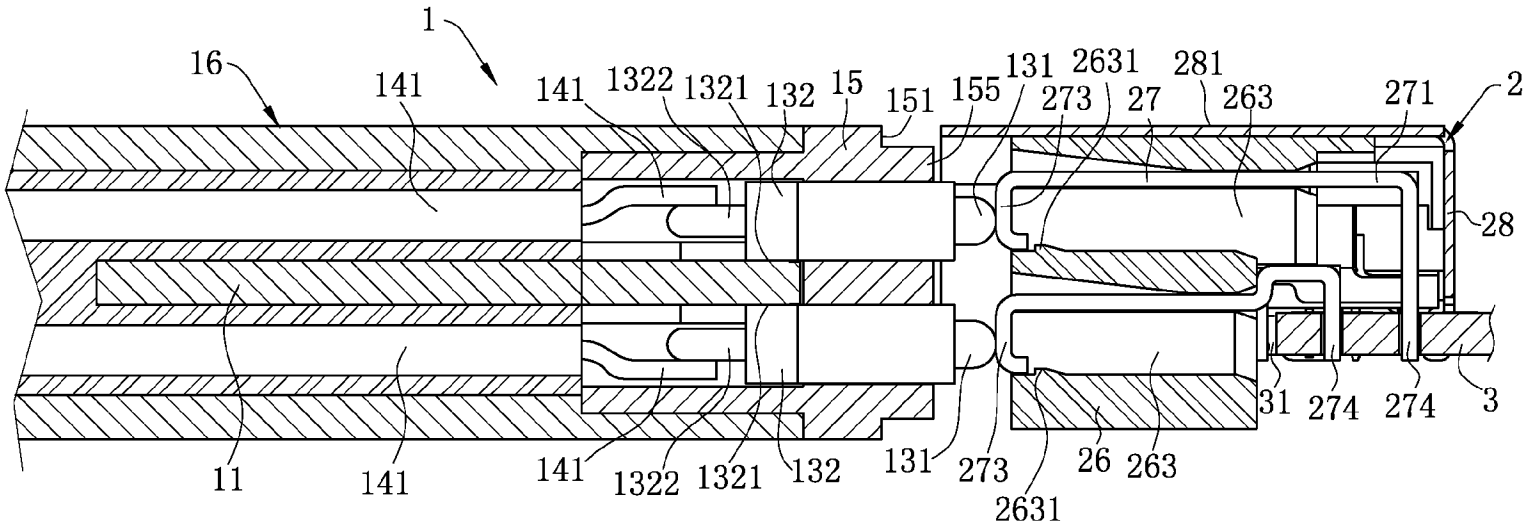
FIG. 13 is a schematic view of the plug connector being mated with the socket connector in FIG. 12.

Referring to FIG. 9 and FIG. 12, the insulating seat 26 has a mating surface 261 facing the plug connector 1 in the front-rear direction, a receiving slot 262 extending in the front-rear direction and multiple accommodating slots 263. The receiving slot 262 and the accommodating slots 263 respectively penetrate through the insulating seat 26 in the front-rear direction. The terminal module 20 is accommodated in the receiving slot 262 and fixedly provided in the receiving slot 262, and the mating frame port 251 is exposed from the mating surface 261. Each accommodating slot 263 is provided with a stopping portion 2631 adjacent to the mating surface 261. In this embodiment, the number of the accommodating slots 263 is four, and two of the accommodating slots 263 vertically provided correspondingly are distributed on each of the left side and the right side of the receiving slot 262.

Referring to FIG. 9 and FIG. 12, in this embodiment, each of the mating power terminals 27 is formed by stamping and bending a metal sheet. Each of the mating power terminals 27 has a fixing portion 271, an extending portion 272 extending from one end of the fixing portion 271, a mating portion 273 formed by bending and extending from the extending portion 272 and a connecting leg 274 formed by bending and extending from the other end of the fixing portion 271. Both the fixing portion 271 and the extending portion 272 extend in the front-rear direction. The fixing portion 271 is retained to a corresponding accommodating slot 263. The mating portion 273 extends in the vertical direction, and the mating portion 273 is exposed from the mating surface 261. An extension tail of the mating portion 273 is limited by the stopping portion 2631 to prevent the mating portion 273 from being excessively forced and deflecting into the accommodating slot 263, and the connecting leg 274 is exposed from the insulating seat 26 and electrically connected with the main board 3.

Referring to FIG. 10, the metal fixing member 28 is a "Π" shaped structure formed by stamping a plate. The metal fixing member 28 has a top plate 281 and two side plates 282 extending downward from two sides of the top plate 281. The top plate 281 and the metal shell 25 are provided to be vertically separated. The metal fixing member 28 has at least one connecting sheet 283 formed by bending downward from the top plate 281. The connecting sheet 283 and the metal shell 25 are fixed to each other by spot welding or laser. Each of the side plates 282 has multiple fixing legs 284, and at least one of the fixing legs 284 is distributed on each side of the mounting notch 31 and used to be soldered and fixed with the main board 3.

Referring to FIG. 3, FIG. 11, FIG. 12 and FIG. 13, when the plug connector 1 butts the socket connector 2 forwardly or reversely, the mating joint 12 is inserted into the mating frame port 251, and the tongue 212 is inserted into the mating slot 1211. At this time, each of the latch portions 1233 is buckled to the corresponding latch notch 231, the second contact portions 221 are correspondingly in contact with the first contact portions 1221 to form an electrical connection, and the mating portions 273 are correspondingly in contact with the conducting portions 131 to form another electrical connection. The conducting portions 131 are pressed by the mating portion 273, such that the conducting portions 131 move backward relative to the tail portions 132, thereby allowing the mating portions 273 to form stable electrical contacts with the conducting portions 131. Further, since the connecting sheet 283 and the metal shell 25 are fixed to each other by spot welding or laser, and the fixing legs 284 are fixed to the main board 3, the mating frame port 251 suspended at the mounting notch 31 is not easily biased by the force when the plug connector 1 and the socket connector 2 are mated with each other.

Referring to FIG. 1, of course, the plug connector 1 may be only provided with the two outer power terminals 13, and of course, one of the two outer power terminals 13 is a positive pole power terminal, and the other one is a negative pole power terminal. The two outer power terminals 13 may be provided on one side of the mating joint 12, or may also be provided on the left and right sides of the mating joint 12. The socket connector 2 is correspondingly provided with the two mating power terminals 27 mated with the two outer power terminals 13. Thus, the plug connector 1 can only be mated with the socket connector 2 in one direction.

To sum up, the connector assembly according to certain embodiments of the present invention has the following beneficial effects:

1. By additionally providing the outer power terminals 13 in the plug connector 1 and additionally providing the mating power terminals 27 in the socket connector 2, when the plug connector 1 is mated with the socket connector 2, the outer power terminals 13 are in contact with the mating power terminals 27, and the conductive terminals 122, which includes the inner power terminals 122*a* and the signal terminals 122*b*, are simultaneously in contact with the mating terminals 22 to form an electrical connection. Thus, the plug connector 1 and the socket connector 2 simultaneously transmit currents through the inside and outside to implement additional current transmission. In addition, the outer power terminals 13 are fixedly provided on the circuit board 11 inside the plug connector 1, and the outer power lines 141 of the cable 14 are electrically connected to the tail portions 132 of the outer power terminals 13. Thus, the outer power terminals 13 can be stably fixed relative to the circuit board 11.

2. The second solder pads 112 are located in front of the first solder pads 111 in the front-rear direction. The first soldering portions 1222 of the conductive terminals 122 are soldered to the first solder pads 111, and the tail portions 132 of the outer power terminals 13 are soldered to the second solder pad 112. Thus, the tail portions 132 are fixed adjacent to the front end of the circuit board 11, reducing the space on or under the circuit board 11 occupied by the outer power terminals 13 and giving way to electronic components on the circuit board 11.

3. Power transmitted by the outer power terminals 13 provided outside the mating joint 12 is greater than power transmitted by the inner power terminals 122*a* in the mating joint 12. Thus, it is possible to additionally transmit a heavy current.

4. Since the conducting portions 131 are movable relative to the front end surface 151, when the plug connector 1 is mated with the socket connector 2, the conducting portions 131 are pressed by the mating portion 273, such that the conducting portions 131 move backward relative to the tail portions 132, thereby allowing the mating portion 273 to form stable electrical contacts with the conducting portions 131.

5. Since the connecting sheet 283 and the metal shell 25 are fixed to each other by spot welding or laser, and the fixing legs 284 are fixed to the main board 3, the mating frame port 251 suspended at the mounting notch 31 is not easily biased by the force when the plug connector 1 and the socket connector 2 are mated with each other.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A plug connector, comprising:

a circuit board, having a plurality of first solder pads, at least two second solder pads and a plurality of third solder pads electrically connected with the first solder pads, wherein a front end of the circuit board is provided with the first solder pads and the at least two second solder pads, and the circuit board is provided with a notch between one of the first solder pads and one of the at least two second solder pads adjacent to each other;

a mating joint, having an insulating body and a plurality of conductive terminals provided on the insulating body, wherein the conductive terminals are electrically connected to the circuit board and soldered to the first solder pads, the notch reserves a space for the insulating body, and the conductive terminals comprise a plurality of inner power terminals and a plurality of signal terminals;

at least two outer power terminals, wherein each of the outer power terminals has a conducting portion and a tail portion, the tail portion is fixedly provided on the circuit board, the conducting portion is located on a lateral side of the mating joint, and the tail portions of the at least two outer power terminals are soldered to the at least two second solder pads; and a cable, having at least two outer power lines, a plurality of inner power lines and a plurality of signal lines, wherein each of the at least two outer power lines is electrically connected to the tail portion of a corresponding one of the at least two outer power terminals, the inner power lines and the signal lines are correspondingly soldered with the third solder pads, the inner power lines are electrically connected with the inner power terminals respectively, and the signal lines are electrically connected with the signal terminals respectively.

2. The plug connector according to claim 1, wherein each of the at least two outer power lines is directly connected to the tail portion of the corresponding one of the at least two outer power terminals.

3. The plug connector according to claim 1, wherein power transmitted by the at least two outer power terminals is greater than power transmitted by the inner power terminals.

4. The plug connector according to claim 1, comprising four outer power terminals, wherein each of two opposite sides of the mating joint are respectively provided with two of the four outer power terminals, and the conducting portions of the four outer power terminals on the two sides of the mating joint are symmetrically provided.

5. The plug connector according to claim 4, wherein a front end of the insulating body is backward concavely provided with a mating slot, each of the conductive terminals has a first contact portion protruding into the mating slot, the first contact portions of the conductive terminals are provided in two rows on an upper side and a lower side of the mating slot, the two rows of the first contact portions are symmetrical about a center of the mating slot at 180 degrees, and the conducting portions of the four outer power terminals distributed on a left side and a right side of the mating joint are symmetrical about the center of the mating slot at 180 degrees.

6. The plug connector according to claim 5, wherein the two outer power terminals located at each side of the mating joint comprises a positive pole and a negative pole, and the polarities of the outer power terminals located at the opposite sides of the mating joint are symmetrical about the center of the mating slot at 180 degrees.

7. The plug connector according to claim 1, wherein each of the outer power terminals is fixed to the circuit board by soldering at the tail portion thereof.

8. The plug connector according to claim 1, wherein one side of the tail portion of each of the at least two outer power terminals adjacent to the circuit board has a soldering plane, and the soldering plane is soldered to a corresponding one of the at least two second solder pads.

9. The plug connector according to claim 1, wherein the at least two second solder pads are located in front of the first solder pads in a front-rear direction.

10. The plug connector according to claim 1, wherein a front end of the insulating body is backward concavely provided with a mating slot, each of the conductive terminals has a first contact portion protruding into the mating slot, the first contact portions of the conductive terminals are provided in two rows on an upper side and a lower side of the mating slot, and the conducting portions of the at least two outer power terminals are located behind the first contact portions of the conductive terminals in a front-rear direction.

11. A plug connector, comprising:

a circuit board;

a mating joint, having an insulating body and a plurality of conductive terminals provided on the insulating body, wherein the conductive terminals are electrically connected to the circuit board, and the conductive terminals comprise a plurality of inner power terminals and a plurality of signal terminals;

at least two outer power terminals, wherein each of the outer power terminals has a conducting portion and a tail portion, the tail portion is fixedly provided on the circuit board, and the conducting portion is located on a lateral side of the mating joint;

a cable, having at least two outer power lines, a plurality of inner power lines and a plurality of signal lines, wherein each of the at least two outer power lines is electrically connected to the tail portion of a corresponding one of the at least two outer power terminals, the inner power lines are electrically connected with the inner power terminals respectively, and the signal lines are electrically connected with the signal terminals respectively; and an insulating fixing member, wherein the insulating fixing member is provided at a rear end of the mating joint and at the tail portions of the at least two outer power terminals, the insulating fixing member has a front end surface and a projecting portion formed by protruding forward from the front end surface, the projecting portion is formed around the conducting portions of the at least two outer power terminals, a front end of each of the conducting portions of the at least two outer power terminals protrudes forward out of the projecting portion, and a front end of the mating joint and the conducting portions of the at least two outer power terminals respectively protrude out of the front end surface.

12. The plug connector according to claim 11, wherein the conducting portions of the at least two outer power terminals are movable relative to the front end surface along a front-rear direction.

13. The plug connector according to claim 11, wherein an engaging slot is concavely formed forward from a rear end of the insulating fixing member and is configured to clamp the circuit board, and each of the tail portions of the at least two outer power terminals has a solder plane which is exposed from the engaging slot and configured to be attached and soldered to the circuit board.

14. A connector assembly, comprising:

a plug connector, comprising:

a circuit board;

a mating joint, having an insulating body and a plurality of conductive terminals provided on the insulating body, wherein the conductive terminals are electrically connected to the circuit board, and the conductive terminals comprise a plurality of inner power terminals and a plurality of signal terminals;

at least two outer power terminals, wherein each of the outer power terminals has a conducting portion and a tail portion, the tail portion is fixedly provided on the circuit board, and the conducting portion is located on a lateral side of the mating joint; and a cable, having at least two outer power lines, a plurality of inner power lines and a plurality of signal lines, wherein each of the at least two outer power lines is electrically connected to the tail portion of a corresponding one of the at least two outer power terminals, the inner power lines are electrically connected with the inner power terminals respectively, and the signal lines are electrically connected with the signal terminals respectively; and a socket connector, mated with the plug connector, comprising:

a plastic body;

a plurality of mating terminals, provided on the plastic body;

a metal shell, provided outside the plastic body and forming a mating frame port for the mating joint to be inserted therein, wherein each of the mating terminals has a second contact portion provided in the mating frame port, and the second contact portion is in contact with one of the conductive terminals to form an electrical connection;

an insulating seat, provided outside the metal shell, wherein the insulating seat has a mating surface, and the mating frame port is exposed from the mating surface;

at least two mating power terminals, provided on the insulating seat, wherein the mating power terminals are located outside the mating frame port and are in contact with the corresponding conducting portions to form another electrical connection; and a metal fixing member provided outside the insulating seat, wherein the metal fixing member has a top plate and two side plates respectively extending downward from two sides of the top plate, the top plate and the metal shell are provided to be vertically separated, the metal fixing member has at least one connecting sheet formed by bending downward from the top plate, the connecting sheet and the metal shell are fixed to each other by spot welding or laser, and each of the side plates has at least one fixing leg configured to be connected with a main board.

15. The connector assembly according to claim 14, wherein the at least two outer power lines are soldered correspondingly to the tail portions of the at least two outer power terminals.

16. The connector assembly according to claim 14, wherein power transmitted by the at least two outer power terminals is greater than power transmitted by the inner power terminals.

* * * * *